US009782665B2

(12) United States Patent
Mars

(10) Patent No.: US 9,782,665 B2
(45) Date of Patent: Oct. 10, 2017

(54) ROLLER SKATE

(71) Applicant: Marsblade AB, Ostersund (SE)

(72) Inventor: Per Mars, Ostersund (SE)

(73) Assignee: FLOW MOTION TECHNOLOGY AB, Oestersund (SE)

( * ) Notice: Subject to any disclaimer, the term of this patent is extended or adjusted under 35 U.S.C. 154(b) by 0 days.

(21) Appl. No.: 14/789,492

(22) Filed: Jul. 1, 2015

(65) Prior Publication Data

US 2015/0306489 A1 Oct. 29, 2015

Related U.S. Application Data

(63) Continuation of application No. 13/384,457, filed as application No. PCT/SE2011/000016 on Feb. 2, 2011, now Pat. No. 9,101,816.

(30) Foreign Application Priority Data

Feb. 9, 2010 (SE) ..... 1000121

(51) Int. Cl.
*A63C 17/06* (2006.01)
*A63C 17/00* (2006.01)

(52) U.S. Cl.
CPC ..... *A63C 17/065* (2013.01); *A63C 17/0046* (2013.01); *A63C 17/0093* (2013.01)

(58) Field of Classification Search
CPC ..... A63C 17/065; A63C 1/28; A63C 17/0046; A63C 17/062; A63C 1/00;
(Continued)

(56) References Cited

U.S. PATENT DOCUMENTS 304,014 A 8/1884 Lincoln
2,093,915 A 9/1937 Klevstad
(Continued)

FOREIGN PATENT DOCUMENTS

CA 2314631 A1 1/2001
CN 2093669 U 1/1992
(Continued)

OTHER PUBLICATIONS

Office Action for co-pending U.S. Appl. No. 13/578,493 dated Nov. 17, 2013.
(Continued)

*Primary Examiner* — Frank Vanaman
(74) *Attorney, Agent, or Firm* — Harness, Dickey & Pierce, P.L.C.

(57) ABSTRACT

An inline frame for an inline skate, designed to mimic the properties of an ice hockey skate blade on ice. The inline frame includes at least one first connection part intended to be connected to a boot and at least two wheels positioned essentially in the inline frame's longitudinal direction. The unique thing about the inline frame is that it includes an upper chassis section and a lower chassis section which via a coupling element are arranged to be rotatable in the inline frame's longitudinal direction, and that the upper chassis section includes at least one first contact surface and that the lower chassis section includes at least one second contact surface, where at least one of the first contact surface and the second contact surface is curvilinear.

41 Claims, 9 Drawing Sheets

(58) Field of Classification Search
CPC . A63C 2017/1463; A63C 5/075; A63C 10/26; A63C 17/067; A63C 17/262; A63C 3/00; A43B 5/0417; A43B 5/0421; A43B 5/16; A43B 5/1641
See application file for complete search history.

(56) References Cited

U.S. PATENT DOCUMENTS

| | | | | |
|---|---|---|---|---|
| 2,725,238 | A | 11/1955 | Day | |
| 3,822,491 | A | 7/1974 | Rathmell | |
| 4,396,204 | A | 8/1983 | Smirnykh | |
| 4,602,801 | A | 7/1986 | Vincent | |
| 4,691,931 | A | 9/1987 | Vincent | |
| 4,706,974 | A | 11/1987 | Vincent | |
| 5,123,664 | A | 6/1992 | DeMars | |
| 5,125,680 | A | 6/1992 | Bejean et al. | |
| 5,135,244 | A | 8/1992 | Allison | |
| 5,232,231 | A | 8/1993 | Carlsmith | |
| 5,342,071 | A * | 8/1994 | Soo | A63C 17/0046 280/11.207 |
| 5,639,104 | A | 6/1997 | Haldemann | |
| 5,755,449 | A | 5/1998 | Pozzobon | |
| 5,890,724 | A | 4/1999 | Gignoux et al. | |
| 5,927,728 | A | 7/1999 | Gignoux et al. | |
| 5,979,916 | A | 11/1999 | Gatel et al. | |
| 6,007,075 | A | 12/1999 | Shum | |
| 6,113,111 | A | 9/2000 | Gierveld et al. | |
| 6,152,458 | A | 11/2000 | Edauw et al. | |
| 6,227,550 | B1 | 5/2001 | Maggiolo | |
| 6,523,835 | B1 | 2/2003 | Lyden | |
| 6,561,525 | B1 | 5/2003 | Chou | |
| 6,736,412 | B1 | 5/2004 | Krah | |
| 6,843,497 | B1 | 1/2005 | Riepler | |
| 6,971,652 | B2 | 12/2005 | Bobbert et al. | |
| 7,270,343 | B2 | 9/2007 | Riepler | |
| 7,419,187 | B2 | 9/2008 | Haugen et al. | |
| 8,801,025 | B2 * | 8/2014 | Mars | A63C 1/22 280/607 |
| 2003/0116941 | A1 | 6/2003 | Mash | |
| 2005/0051996 | A1 | 3/2005 | Riepler | |
| 2005/0206109 | A1 | 9/2005 | Mash | |
| 2013/0344774 | A1 | 12/2013 | Allen | |

FOREIGN PATENT DOCUMENTS

| | | | |
|---|---|---|---|
| CN | 1094982 | A | 11/1994 |
| CN | 101437585 | A | 5/2009 |
| DE | 78733 | | 1/1894 |
| DE | 29614090 | U1 | 1/1997 |
| DE | 29814854 | U1 | 1/1999 |
| DE | 102005026508 | A1 | 12/2006 |
| EP | 230989 | A2 | 8/1987 |
| EP | 0786275 | A1 | 7/1997 |
| EP | 0795348 | A1 | 9/1997 |
| EP | 0903168 | A1 | 3/1999 |
| EP | 1319424 | A1 | 6/2003 |
| FR | 2758093 | A1 | 7/1998 |
| FR | 2816516 | A1 | 5/2002 |
| JP | H11505733 | A | 5/1999 |
| KR | 20040104861 | A | 12/2004 |
| NL | 8702068 | A | 4/1989 |
| WO | WO-96/37269 | A1 | 11/1996 |
| WO | WO-0009223 | A1 | 2/2000 |
| WO | WO-2007137834 | A1 | 12/2007 |
| WO | WO-2010124382 | A1 | 11/2010 |

OTHER PUBLICATIONS

International Search Report PCT/ISA/210 for International Patent Application No. PCT/SE2012/000036 dated Jun. 12, 2012.
Written Opinion of the International Search Authority for international patent application No. PCT/SE2012/000036 dated Jun. 12, 2012.
International Search Report for International patent application No. PCT/SE2011/000016 dated May 18, 2011.
Notice of Allowance for co-pending U.S. Appl. No. 14/013,608 mailed Jun. 5, 2014.
Chinese Office Action for Chinese Application No. 201180008556.X dated May 9, 2014.
Decision to Grant for corresponding Russian Application No. 2012136138/12(058562) dated Mar. 20, 2015 and English translation thereof.
European Office Action corresponding to Application No. 11 709 229.6-1658 dated Jul. 27, 2017.

* cited by examiner

ROLLER SKATE

CROSS-REFERENCE TO RELATED APPLICATIONS

This is a continuation of U.S. application Ser. No. 13/384,457 filed Feb. 9, 2012, which is a national phase under 35 U.S. C. §371 of PCT International Application No. PCT/SE2011/000016 which has an International filing date of Feb. 2, 2011, which claims priority to Swedish Patent Application No. 1000121-2 filed Feb. 9, 2010, the entire contents of each of which are incorporated herein by reference.

TECHNICAL FIELD

The present invention concerns a type of roller skate or similar. More specifically the present invention regards a roller skate in accordance with the claims.

BACKGROUND OF THE INVENTION

To become a good ice hockey player requires thousands of hours of training in how to skate and play hockey. Several months of vital practice/training are lost each year since many ice hockey players are not able to train/practice hockey on ice during the summer. An alternative solution to this problem is to skate on inline skates during the summer.

The characteristics between traditional inline skate wheel frames and the blade which an ice hockey player skates with on ice differ substantially from each other.

An inline skate frame has a long, flat contact plane with the underlying surface, while the blade of a skate which an ice hockey player has on the ice, is not completely flat, but is arch-shaped along all or part of its length. This means that the element of balance is substantially greater when skating is performed on ice. The long contact surface also makes directional changes more difficult. This difference makes the transferability of training with inline skate frames to hockey blades on ice minute and may explain why few ice hockey players use inline skates in their pre-season training during the summer.

There have long been a number of different solutions that try to remedy the problems that ice hockey players have with practicing pre-season training on inline skates. None of these existing designs have thus succeeded to resolve problems in a satisfactory manner.

The main problem with all previous solutions is that these designs do not achieve the element of balance that is found when skating on ice. Since the blade on an ice hockey skate is wholly or partly arch-shaped, contact with the ice is reduced and consequently the element of balance more difficult. The element of balance of a skate on ice is what makes it more difficult to skate on ice than on "normal" inline skates. But, even if the smaller contact area of the hockey skate blade makes it in one way more difficult to skate on, it does have its advantages compared to the inline skate frame when it comes to acceleration, turning around forward/backward and veering. This is because the skater can more easily adjust their center of gravity on the ice skate blade. The short contact area an ice skate blade has against the skating surface, gives the skater the ability to adjust their center of gravity and pressure on the foot forward and backward without the need to bend his/her ankle and knee. This gives a feeling of not being "stuck" in the same way as skaters feel when skating on "normal" inline skates. This is because an ice skate blade during the acceleration stride can maintain contact between the blade and the ice in a controlled manner for a long time since the skater can "roll" forward on the blade. On an inline skate frame it is more of an "all or nothing" principle. If the skater does not bend his/her ankle they are forced to lift the back three rear wheels from the underlying surface and only front wheel contact is left, which alone is hard to push off with. The usual inline skate frame thus provides more control because the contact area is larger, but this brings the problem of fast turns being much more difficult and it is also much harder to accelerate compared with a skate on ice.

Some designs have tried to solve the problem with the skater's feeling of "being stuck" by hanging up the wheels in different ways so that when the skater leans forward and pushes off only one or two wheels lift from the skating surface. This reduces to some extent the feeling of "being stuck" because the skater can perform a powerful push without bending his/her ankle to an unnatural extent (relative to what is needed on ice). The problem with these designs is that the skater still does not have the element of balance that he or she has on the ice.

Physiologically speaking, the above mentioned differences results in a skater having a completely different muscle activation when skating with skates on ice compared to when skating is performed with inline skates. Because the effects of fitness and speed training are mostly located to the muscles that are trained, this means that training effects from inline skating has a very low transmissibility to skating on ice, which is highly detrimental to the athletes who mainly exercise to improve their performance in sports based on ice skating. Training means to continually challenge the body in different ways by setting higher goals to improve a physical characteristic. Because balance is for example one of an ice hockey player's main physical characteristics, pre-season training should also include training that develops balance and thus leads to improvement. Improved balance leads to more efficient skating, which means that a skater on ice can skate longer with the same fitness level. Moreover, good balance is fundamental for, in a technically sound manner, implementing all other aspects of play that an ice hockey player faces, such as shots on goal, passes, tackles and more.

By using a "regular" inline skate frame in his/her pre-season training with a much simpler element of balance than for example an ice hockey player has on the ice, the effect is the opposite of what is desired, which is a major drawback. The body adapts to the simpler element of balance and when the player later returns to skate on the ice all aspects are perceived difficult and taxing. This is largely because skating efficiency and balance have deteriorated since the body has adapted to a simpler element of balance.

The present invention is designed to solve the above problems. With the present design an ice hockey player can for example skate on inline skates with the same element of balance as on ice. It is also possible to skate with an element of balance which is more difficult than an ice hockey player has on ice. This removes the problems of existing designs which cannot challenge the body's sense of balance, so the body is forced to refine its movements. Nor do existing designs improve skating efficiency and balance enough, which is fundamental to a good technical execution of all aspects of play that for example an ice hockey player faces. Furthermore, the present invention's element of balance provides muscle activation similar to that for example, an ice hockey player has on ice. This eliminates the problems associated with existing designs which cannot transfer the effects of fitness and speed training to skating on ice. Further, the present design's wheel placement allows for the contact surface with the ground at a given location to be substantially less than with the traditional inline skate frame, which helps facilitate changes in direction and further emulates the ice skate blade's properties on ice.

The design according to patent document WO0009223 has tried to solve the above problems by hanging the two middle wheels on their own suspension. The design allows a skater to take three different positions on the wheels, on the three forward wheels, on the two middle or on the three rear wheels. This allows the skater, to some extent, to alleviate the feeling of "being stuck". However, there are still only three wheels that have contact with the ground during push off, which still gives a very long contact with the surface and is therefore inadequate. A certain small element of balance can be achieved with the design, because it is possible to sway a bit forward and backward, but still only on three positions. The element of balance therefore becomes shaky and rough, which removes much of the feeling that an ice skate blade has when used on ice. Therefore this design will not solve said problems which distinguishes this design in a substantial way from the present invention.

The design according to patent document EP0786275 by applicant Ski Rossignol is structured like a "clap skate" with a center of rotation above the second forward wheel. The pivot point (rotational center) lessens the feeling of "being stuck". This design differs significantly from the present invention and solves a completely different purpose. For example, the design provides a very limited element of balance, which removes any association to ice hockey skates or similar.

SUMMARY

The main purpose of the present invention is to at least mimic the element of balance when skating on ice and also provide muscle activation with an element of balance that is more difficult than normal ice skating can offer. A further purpose of the present invention is that the effects of fitness and speed training, which are achieved with the present design, should be transferable to skating on ice. Another purpose is to facilitate changes in direction when skating. Yet a further purpose of the design according to the present invention is to achieve a significant improvement in the above mentioned problems with existing designs, especially the problem with the feeling of "being stuck" as described above. Yet another purpose, for skaters who use inline skates as exercise training, is to make the transitions from acceleration softer, and thereby provide a less clumsy feeling when skating.

DETAILED DESCRIPTION OF THE INVENTION

The invention will be described in greater detail below with reference to the accompanying schematic drawings that in an exemplifying purpose show the current preferred embodiments of the invention.

Figure 5A:
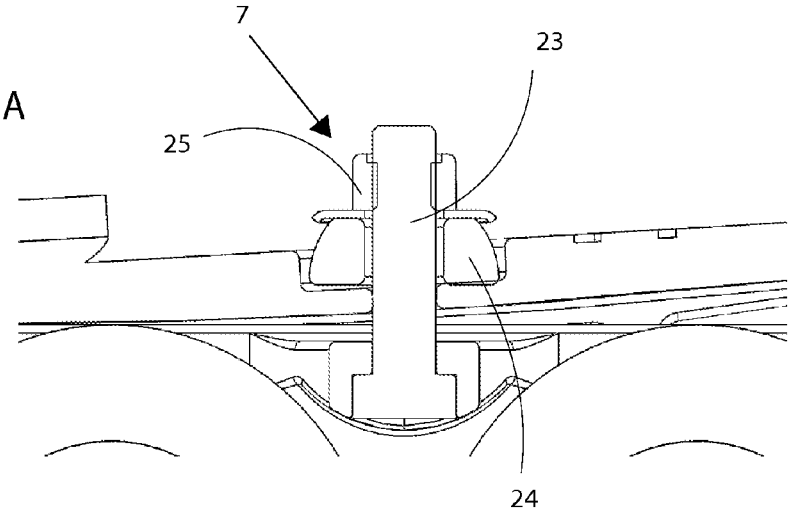
Figure 5B:
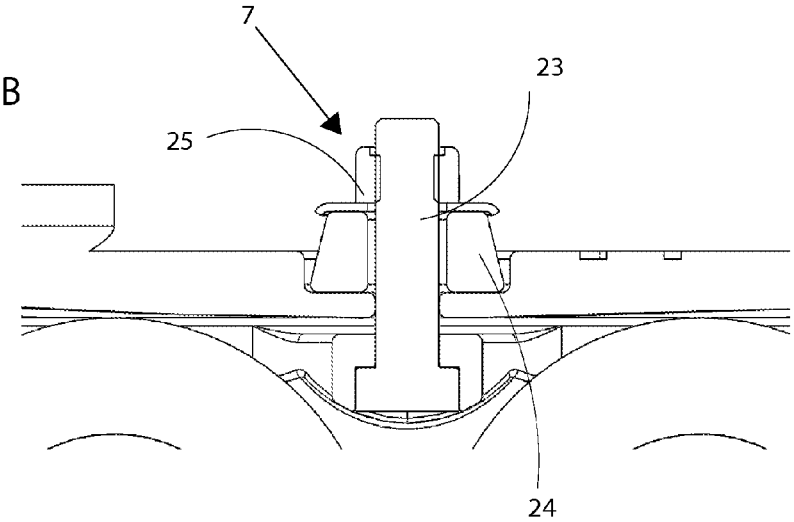
Figure 5C:
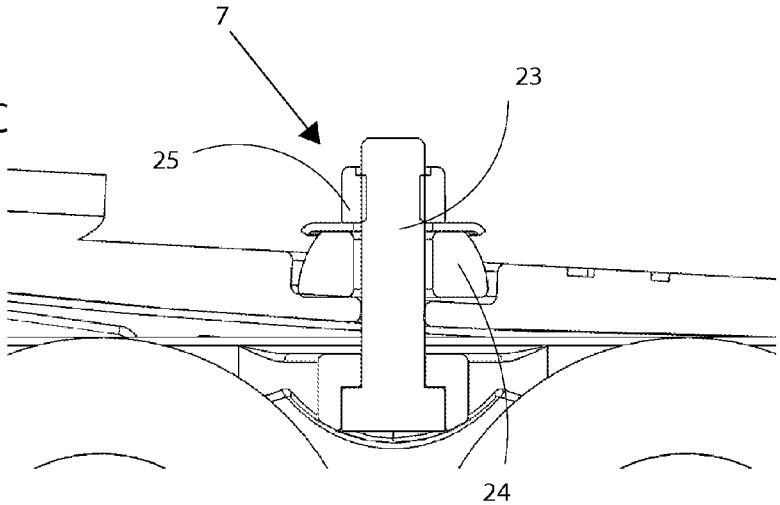

FIG. 5 *a-c* shows the joint function in more detail.

Figure 6A:
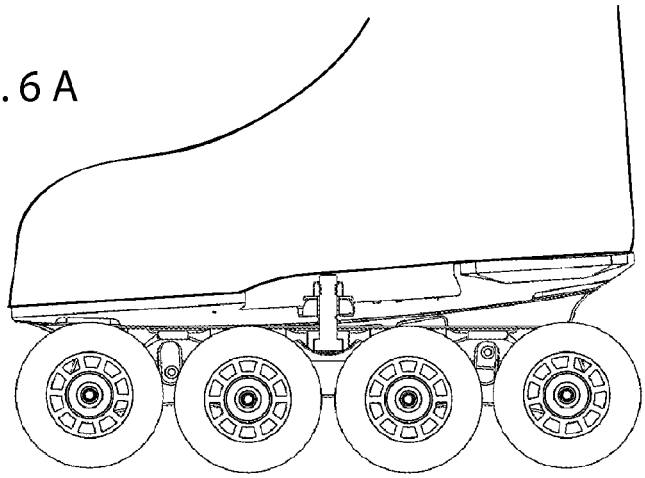
Figure 6B:
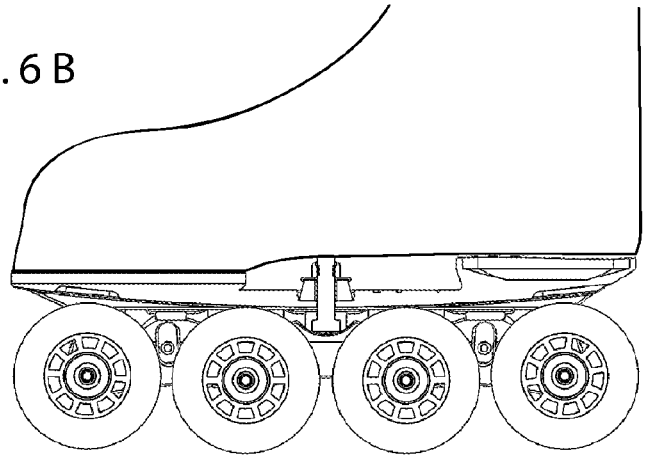
Figure 6C:
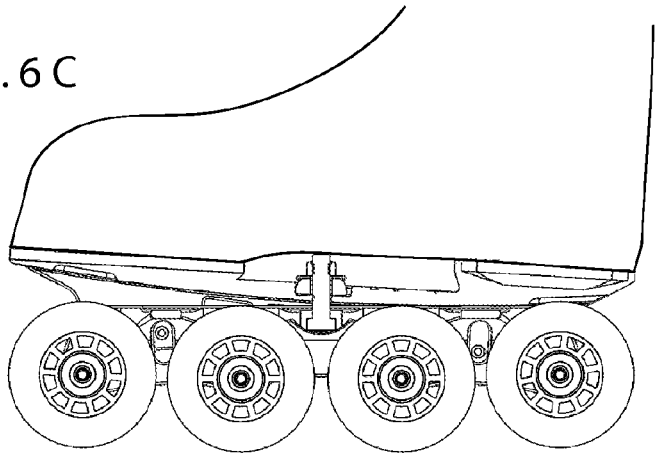

FIG. 6 *a-c* shows the present inline frame's function.

Figure 7A:
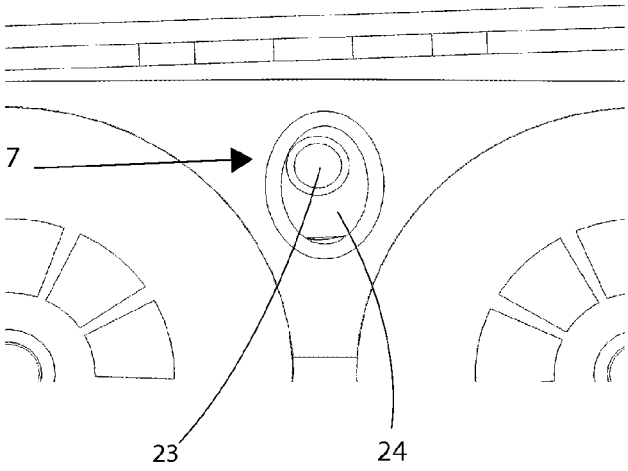
Figure 7B:
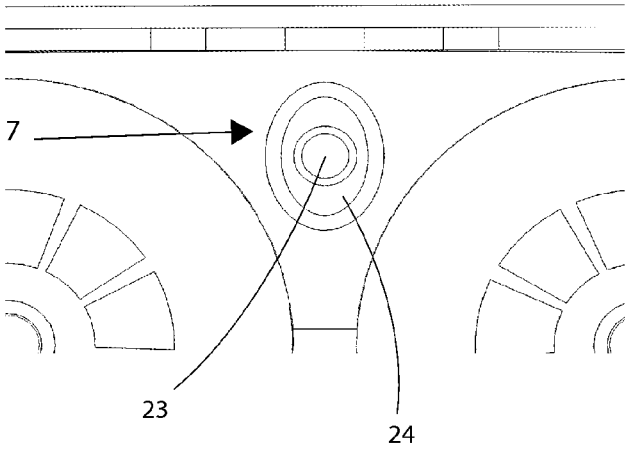
Figure 7C:
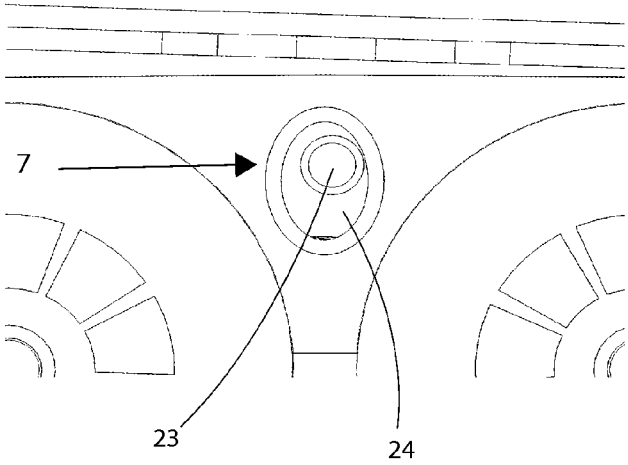

FIG. 7 *a-c* shows an embodiment of the present invention.

Figure 8A:
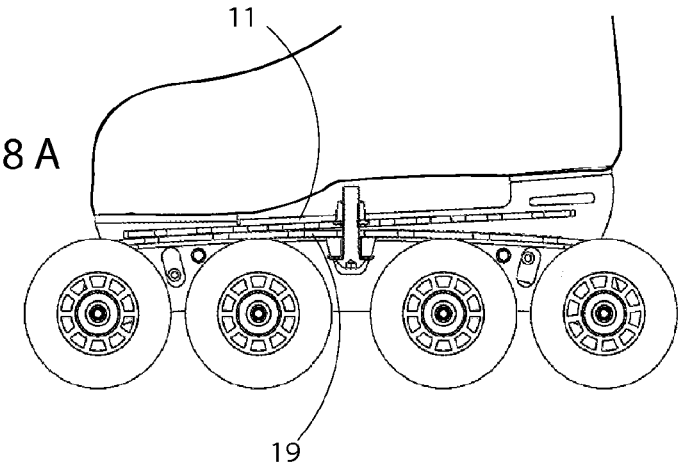
Figure 8B:
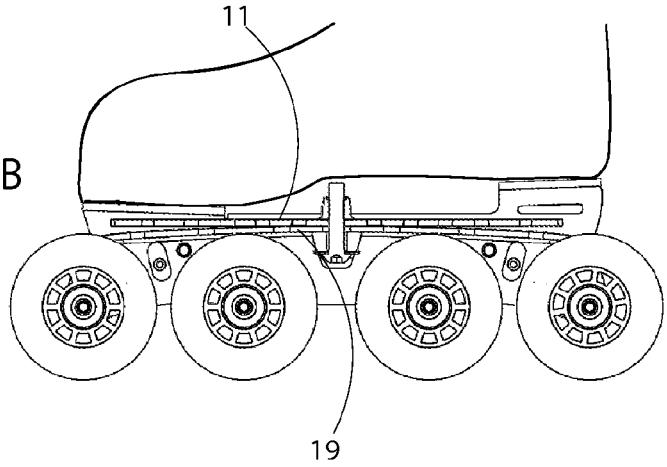
Figure 8C:
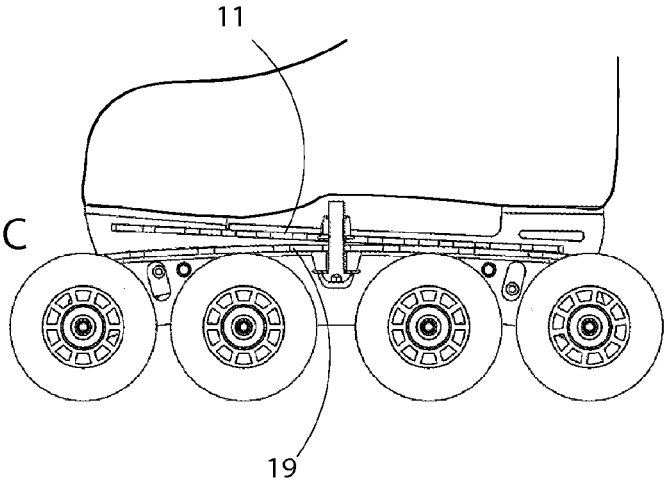

FIG. 8 *a-c* shows an embodiment of the present invention.

Figure 9A:
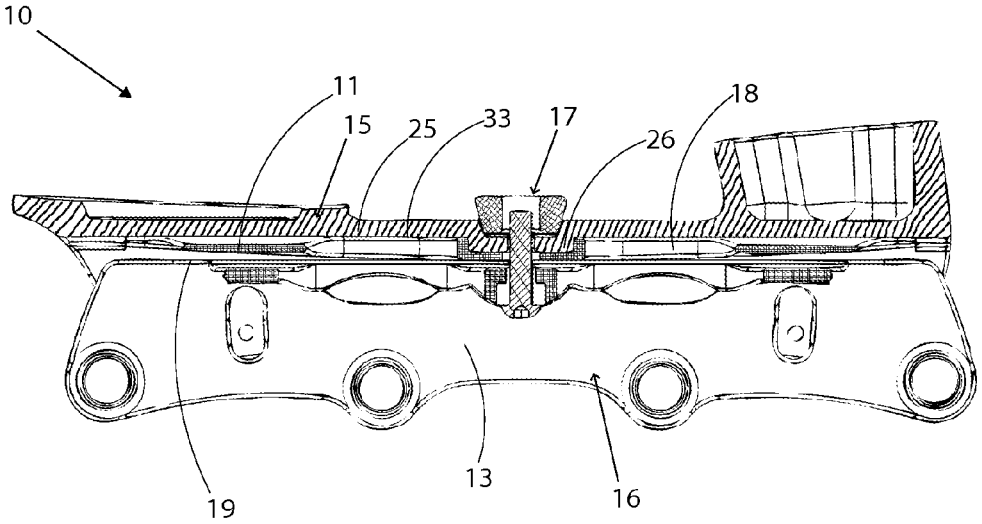
Figure 9B:
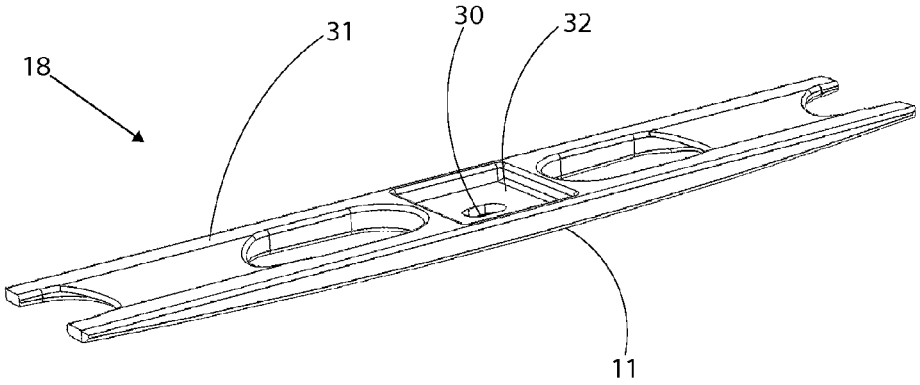

FIG. 9 *a* shows an inline frame, and FIG. 9 *b* is a perspective side view of a separate chassis element according to an embodiment of the present invention.

Figure 10:
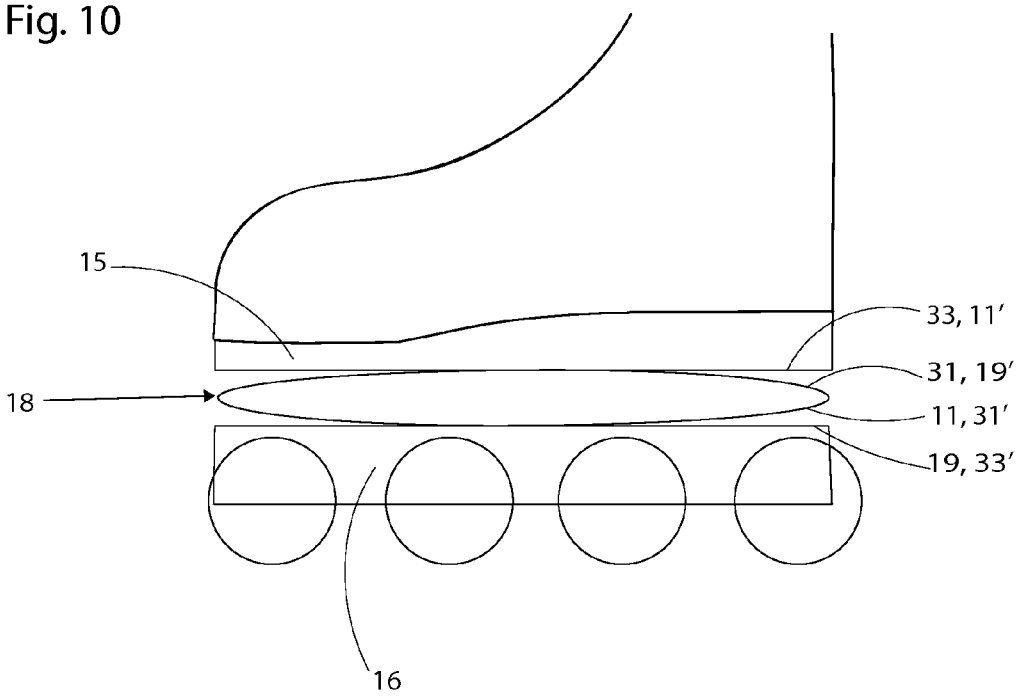

FIG. 10 is a side view illustration of an inline frame according to an embodiment of the invention.

Figure 11A:
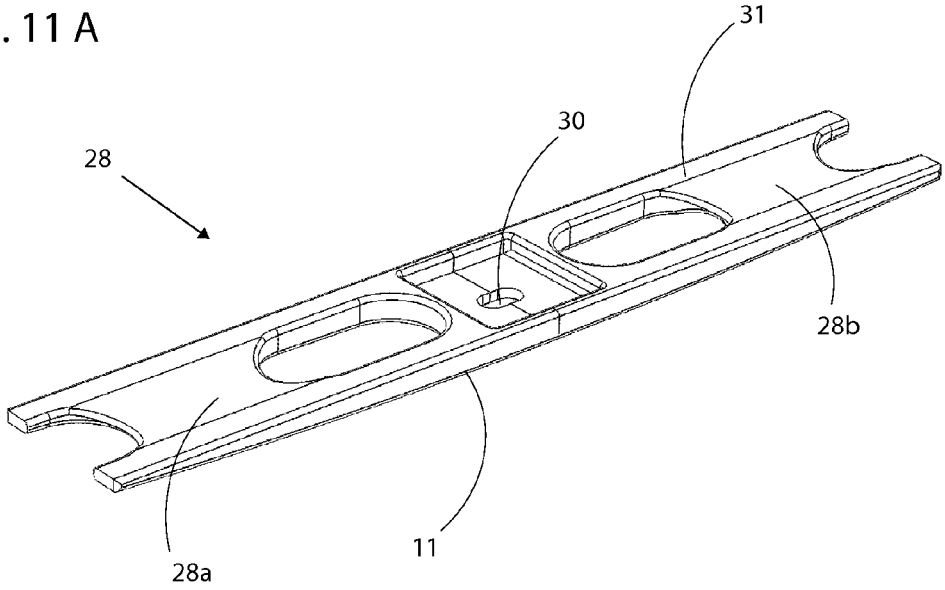
Figure 11B:
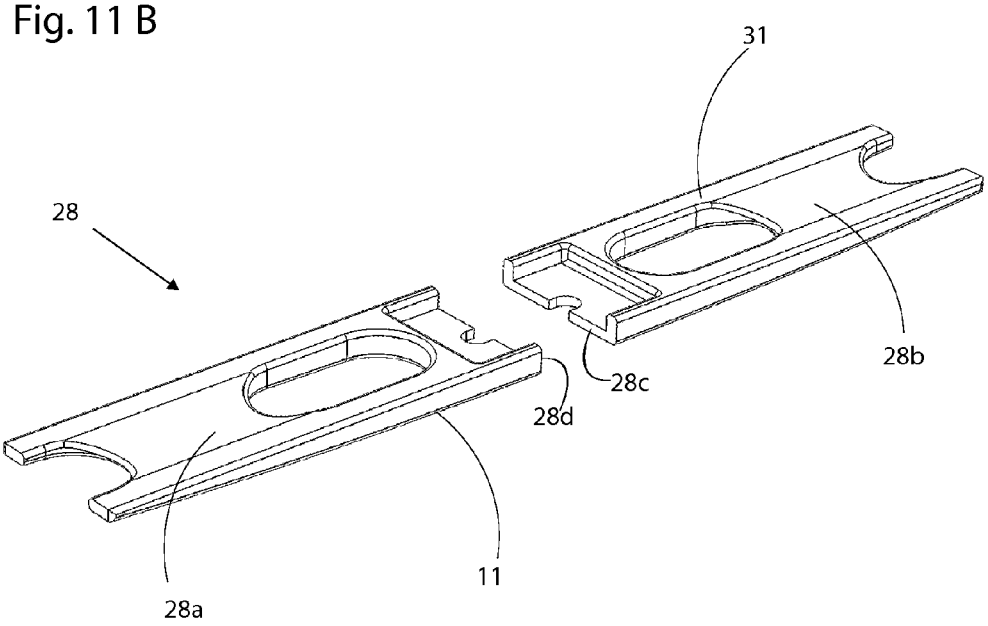
Figure 11C:
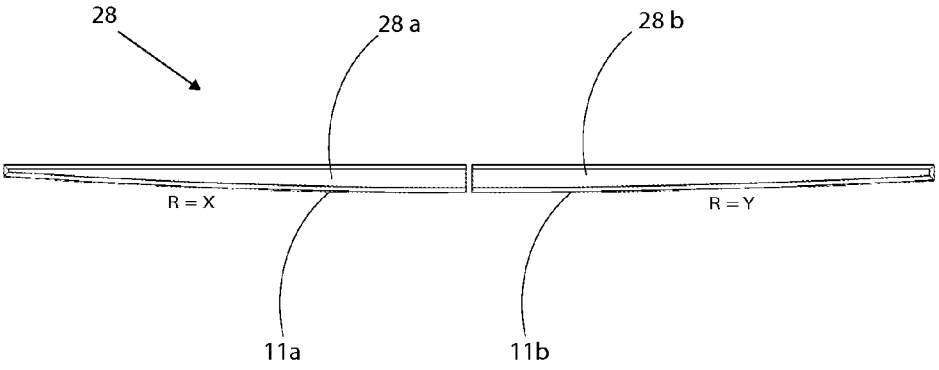

FIG. 11 *a-c* illustrates embodiments of a separate chassis element according to an embodiment of the present invention.

With reference to the figures an inline skate with an inline skate wheel frame 1 in accordance with the present invention is shown. The inline frame 1 is intended to be connected to a boot shell 2 or similar. The boot 2 has a toe section 3 and a heel section 4. The boot 2 is made up of some previously known variety of boot suitable for the purpose. The type of boot 2 does not limit the scope of protection of the present invention therefore it is not described in more detail in this patent application. The inline frame 1 includes at least one chassis which includes at least one upper chassis section 5 and at least one lower chassis section 6. The lower chassis section 6 includes at least one first wheel and at least one second wheel. The upper chassis section 5 and the lower chassis section 6 are connected to each other via at least one coupling and spring back element 7. The coupling element 7 allows for the upper chassis section 5 and the lower chassis section 6 to be rotated relative to each other along the direction of the inline frame in accordance to what is shown in FIG. 5 *a-c*.

Figure 1:
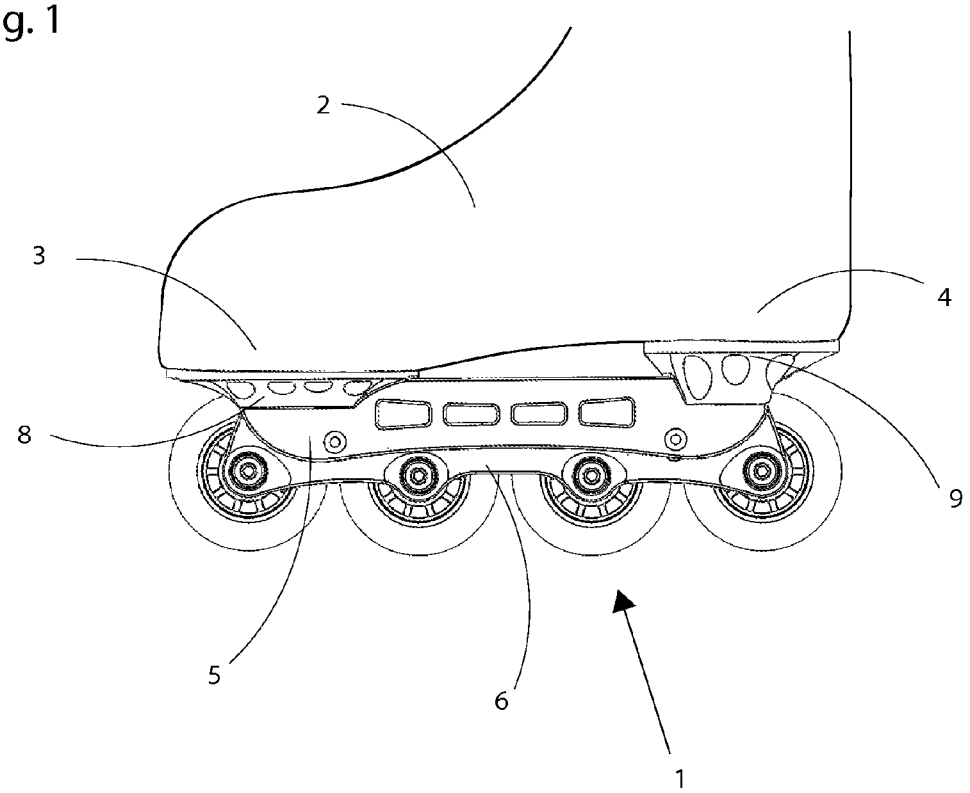
FIG. 1 shows an inline skate with an inline wheel frame in accordance with the present invention.
Figure 2:
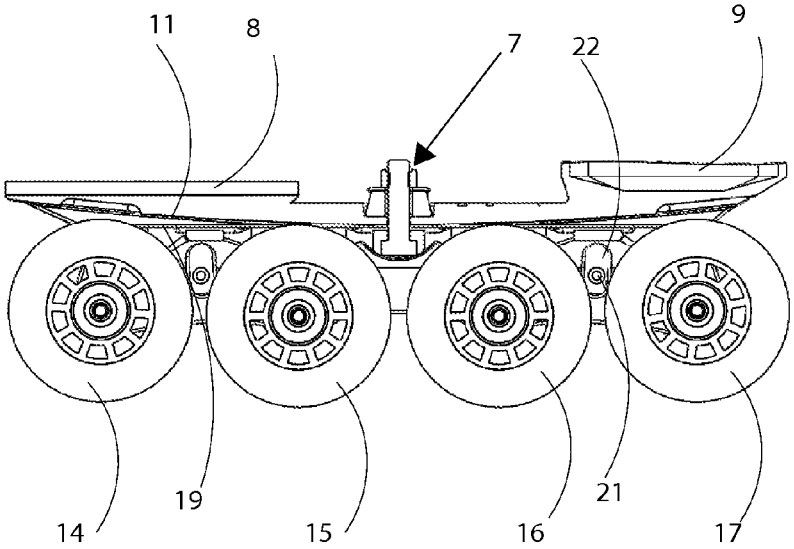
FIG. 2 shows a cross-sectional view of an inline frame in accordance with the first embodiment.
Figure 3:
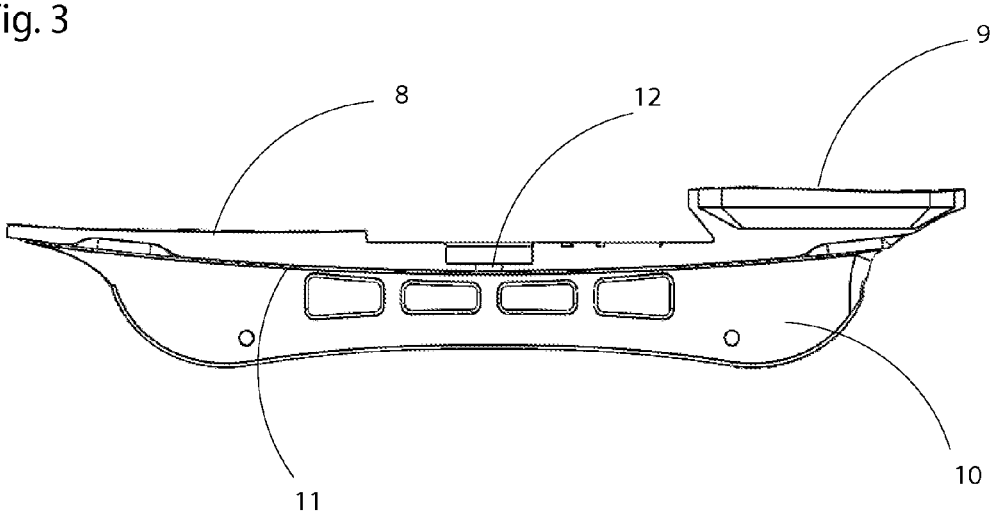
FIG. 3 shows in more detail a cross-sectional view of the upper chassis section included in the inline frame.

FIG. 3 shows a preferred embodiment of the upper chassis section 5. The displayed embodiment constitutes only one possible embodiment of the upper chassis section 5 and is not considered to limit the scope of protection of the present invention. The upper chassis section 5 preferably includes a front connection part 8 and a rear connection part 9 which enables attachment to the boot 2. The front connection part 8 and the rear connection part 9 may in alternative embodiments be integrated in one connecting part. The front connection part 8 is intended to be connected to the boot's 2 toe section 3. The rear connection part 9 is intended to be connected to the boot's 2 heel section 4. The upper chassis section is comprised of, in the exemplifying embodiment, at least two essentially vertical segments 10 which run along either outside of the lower chassis section 6. Alternatively, the vertical segments 10 may have another for the purpose appropriate direction and form. The distance between the vertical segments 10 exceeds at minimum the width of the lower chassis section 6. The vertical segments' 10 technical effect is to increase torsional rigidity and to restrain the relative movement between the lower chassis section 6 and the upper chassis section 5. The upper chassis section's 5 bottom, in the frame's longitudinal direction between the two vertical segments 10, is provided with at least one first contact surface 11. The first contact surface 11, in the preferred embodiment, is curvilinear such as a radius shape. The first contact surface 11 may in alternative embodiments be of another for the purpose suitably arch-shaped surface. The upper chassis section 5 in the vertical direction is provided with at least one through hole 12. In order to make the frame lighter it can be fitted with cavities, holes or similar in the vertical segments 10. In different versions of the invention, the upper chassis section 5 may be constructed without the vertical segments 10.

Figure 4:
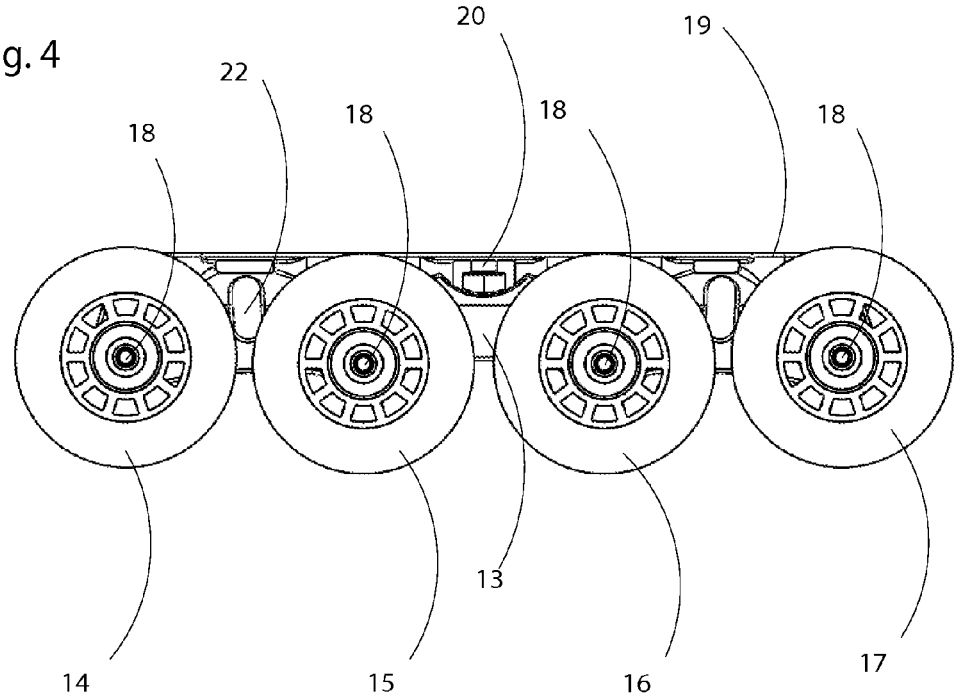
FIG. 4 shows in more detail a cross-sectional view of the lower chassis section included in the inline frame.

FIG. 4 shows a preferred embodiment of the lower chassis section 6. The lower chassis section includes a body 13 which is equipped with at least one first wheel 14 and at least one second wheel 15. In the preferred embodiment the lower chassis section 6 includes at least a third wheel 16 and at least a fourth wheel 17. Each respective wheel is, in accordance with prior art, mounted in bearings in relation to the lower chassis section 6. In the shown embodiment each wheel is mounted in bearings, via ball bearings, plain bearings or similar to a wheel axle 18. The upper part of the lower chassis section's 6 body 13 consists, in the first embodiment, of at least one second contact surface 19 which is flat as shown in the embodiment of FIG. 4. The lower chassis section 6 is in the vertical direction provided with at least one through hole 20.

In the exemplary embodiment the upper chassis section 5 and the lower chassis section 6 includes at least one and preferably two stiffening elements 21. In the figures the stiffening element 21 is exemplified by a threaded rod and two screws. The threaded rod is fastened with screws in the upper chassis section 5 and runs through a groove 22 in the lower chassis section 6. The technical effect of the stiffening element 21 is that the torsional rigidity of the inline frame 1 increases. During torsion between the upper chassis section 5 and the lower chassis section 6, the stiffening element 21 moves freely in the groove 22. In alternative embodiments the inline frame 1 may be arranged without the stiffening element 21 and groove 22 in the lower chassis section 6.

FIG. 5 *a-c* shows the exemplified coupling element 7 and its function. In the first embodiment of the present invention shown in the figures, the coupling element 7 consists of at least one axle 23 arranged in a vertical direction which passes through the through hole 20 in the lower chassis section 6 and the through hole 12 of the upper chassis section 5. The technical function is that the coupling element 7 holds the upper chassis section 5 and the lower chassis section 6 together. The axle 23 may consist of a screw, bolt or similar. At least one bushing 24 is connected around the axle 23. The bushing 24, on its top side, may be held together by at least one nut 25 or other component suitable for this purpose. The bushing 24 may consist for example of rubber, a rubber-like material or other suitable material for the purpose.

The parts which are explained in detail above allow for the inline frame's unique stepless element of balance. FIG. 6 *a-c* shows the practical function of the inline frame when the parts work together and this is explained in more detail in the following text.

The upper chassis section's 5 curvilinearly formed first contact surface 11 rests against the lower chassis section's 6 flatly formed second contact surface 19. The coupling element 7 holds together the upper chassis section 5 and the lower chassis section 6. Since the coupling element 7 includes a bushing 24 which is flexible and able to spring back, movement between the upper chassis section 5 and the lower chassis section 6 is possible. When the skater puts pressure on the boot's 2 toe section 3 or heel section 4 the upper chassis section's 5 curvilinearly formed first contact surface 11 and the lower chassis section's 6 flatly formed second contact surface 19 move relative to each other. Preferably, the curvilinearly formed first contact surface 11 rolls against the flatly formed second contact surface 19. The bushing 24 is thus pressed together, under the buildup of energy, on the side where the skater puts pressure. When the pressure is released the bushing 24 returns to its original form thanks to its springy effect giving off energy. Depending on how tightly screwed the axle 23 or nut 25 is and how highly compressed the bushing 24 is, causes, at a given force, different levels of movement between the lower chassis section 6 and the upper chassis section 5. By tightening the axle 23 and the nut 25 the bushing compresses and the range of the movement, at a given force, between the lower chassis section 6 and the upper chassis section 5 becomes smaller. If the axle 23 and the nut 25 are instead loosened the bushing 24 is compressed less and the amount of movement, at a given force, between the lower chassis section 6 and the upper chassis section 5 instead becomes larger.

In the exemplifying embodiment, the first wheel 14 and the fourth wheel 17 are arranged higher up in the vertical direction than the second wheel 15 and the third wheel 16. This means that one or more of the wheels 14, 15, 16, or 17 never touches the ground. The result of this is that the skater can more easily change his/her direction of travel when friction against the ground during torque is lower than if all four wheels touch the ground. Furthermore, this leads to the properties of the inline frame 1 further mimicking an ice hockey blade's properties on ice. In alternative embodiments, it is also conceivable that at least one of the wheels has a smaller diameter than the other wheels. The result is that the skater can more easily change his/her direction of travel when friction against the ground during torque is lower than if all four wheels touch the ground. In alternative embodiments, it is also conceivable that at least one of the wheels is positioned higher up in the vertical direction than the other wheels.

With reference to FIG. 7 *a-c*, a first alternative embodiment of the inline frame in accordance with the present invention is shown. In this embodiment the coupling element 7 includes at least one axle 23 which is arranged in essentially a horizontal direction. The axle 23 is mounted in at least one bushing 24 in the lower chassis section.

With references to FIG. 8 *a-c*, a second alternative embodiment of the inline frame in accordance with the present invention is shown. In this embodiment the lower chassis section 6 includes at least one second contact surface 19 that is preferably curvilinearly formed and the upper chassis section 5 includes at least one first contact surface 11 which is flat. In other alternative embodiments, it is conceivable that both the first contact surface 11 and the second contact surface 19 are radius shaped or of another for the purpose suitably shaped arch-form. It is also conceivable that the first contact surface 11 and/or the second contact surface 19 is/are only partially curvilinearly formed.

According to an embodiment of the invention, at least one of the first contact surface and the second contact surface is arranged to be exchangeable. An exemplifying embodiment of this is illustrated in FIG. 9 *a-b*, in which an inline frame 10, having basically the same configuration as the inline frame as described above with reference to FIGS. 1 to 4, is shown. The inline frame 10 comprises an upper chassis section 15 and a lower chassis section 16, which are connected to each other by means of a coupling and spring back element 17. As previously described the lower chassis section 16 is arranged for including wheels, which are not illustrated here for case of simplicity. The upper surface of the lower chassis section's 16 body 13 comprises the second contact surface 19, which is here is flat, but which may alternatively be curvilinearly formed. The inline frame 10 further comprises an elongated separate chassis element 18 which lower surface comprises the first contact surface 11. The first contact surface 11 arranged on the lower surface of the separate chassis element is here curvilinearly formed. The separate chassis element 18, see close up in FIG. 9 *b*, is arranged to fit between the upper chassis section 15 and the lower chassis section 16, and its upper surface 31 is adapted to at least partly bear against the upper chassis section lower contact surface 33, thereby forming an exchangeable chassis element comprising the first contact surface. The chassis element 18 further comprises a through hole 30 for keeping the separate chassis element 18 in place between the upper chassis section 15 and the lower chassis element 16 by means of the coupling element 17. The coupling element 17 allows for the upper chassis section 15, the separate chassis element 18 and the lower chassis section 16 to be rotated relative to each other along the direction of the inline frame 10. By providing a separate chassis element 18 which can be dismounted from the inline frame, it is exchangeable, i.e. different chassis elements comprising the first contact surface, with different curvatures of the first contact surface can thus be employed in the inline frame.

According to an embodiment of the inline frame, instead of providing a separate chassis element comprising the first contact surface, the separate chassis element is arranged such that its lower surface is adapted to at least partly bear against the lower chassis section upper contact surface, while the separate chassis elements upper surface comprises the second contact surface (not shown).

According to an embodiment of the inline frame, as illustrated in FIG. 10, the separate chassis element 18 is arranged comprising both a first and a second contact surface according to the inventive concept. Consider the separate chassis element 18, which is an elongated body in which both the upper surface and the second surface are curved. From a first point of view, the upper surface 31 of the separate chassis element 18 at least partly bears against the lower contact surface of the upper chassis element 15 and forms part of the upper chassis element 15, while its lower contact surface constitutes a first contact surface 11 which works against an upper contact surface 19 of the lower chassis element 16, thereby providing a corresponding second contact surface. Simultaneously, when considering the upper surface 19' of the separate chassis element as a second contact surface working against the lower contact surface of the upper chassis element 15, which then constitutes a corresponding first contact surface 11', the lower contact surface 31' of the separate chassis element 18 at least partly bear against the upper contact surface 33' of the lower chassis element 16 forming part of the lower chassis element. That is, a double set of first and second contact surfaces for the upper and lower chassis sections is provided.

In an embodiment of the inline frame, the upper chassis section or the lower chassis section comprises a protruding guide portion, see e.g. guide portion 26 on the upper chassis section 15 in FIG. 9 *a*, and the separate chassis element 18 comprises a corresponding receiving portion (or vice versa), see receiving portion 32 in FIG. 9 *b*, for facilitating a correct positioning of the separate chassis element.

To continue with reference to FIG. 9, by arranging at least one of the first contact surface 11 and the second contact surface 19 to be exchangeable the user can in a convenient manner adjust the amount of movement between the lower chassis section 16 and the upper chassis section 15. By exchanging at least one of the first contact surface 11 and the second contact surface 19 of the inline frame 10 to a contact surface having a larger radius, or another for the purpose suitably shaped arch-form, the maximum amplitude of the movement between the lower chassis section 16 and the upper chassis section 15 is decreased. On the other hand, by exchanging at least one of the first contact surface 11 and the second contact surface 19 of the inline frame 10 to a contact surface having a smaller radius, or another for the purpose suitably shaped arch-form, the maximum amplitude of the movement between the lower chassis section 16 and the upper chassis section 15 is increased. Preferably, the separate chassis element comprising at least one of the first and second contact surfaces is not fixated to its corresponding chassis section, thus it is freely arranged without any fastening means, but is kept in position by the compressing force which is provided onto the upper chassis section 15 and the lower chassis section 16 by the coupling element 17. Alternatively, the separate chassis element comprising at least one of the first and second contact surfaces is fixated to the corresponding upper or lower chassis section by means of e.g. screwing, gluing or by using quick fastening means like clips.

According to an embodiment of the inline frame, the separate chassis element comprising at least one of the first and second contact surfaces is divided in two separate parts. Preferably the separate chassis element is divided such that the first and/or second contact surfaces are divided in the lateral direction of the inline frame, see e.g. FIG. 11 *a*, which shows a separate chassis element 28, similar to the separate chassis element 18 described with reference to FIG. 9, comprising a first contact surface 11, which separate chassis element 28 is further structured such that it comprises a separate front portion 28*a* and a separate rear portion 28*b*. FIG. 11 *b* illustrates the front portion 28*a* and the rear portion 28*b* when separated. The separate chassis element 28 is divided at its center such that the through hole 30 is divided. This facilitates the dismounting and mounting of the separate chassis element 28 on the inline frame 10, since the coupling element 17 does not have to be completely dismounted to be inserted in the through hole 30. The front portion 28*a* and the rear portion 28*b* may be mounted into the correct position between the upper chassis section 15 and the lower chassis section 16 by being inserted from opposite directions (from the front and the rear of the inline frame, respectively). The front portion 28*a* and the rear portion 28*b* are kept in place by any suitable fixating means, e.g. clips, screws, protruding and corresponding receiving portions arranged in the cross surfaces 28*c*, 28*d* of the portions (not shown).

By dividing the separate chassis element comprising the first contact surface or the second contact surface in two portions, the front portion and the rear portion, the radius R and/or shape of the curvature along the first and/or second contact surface can be adapted to the choice of the user, by combining front and rear portions with different radii and/or for the purpose different suitably shaped arch-forms. FIG. 11 *c* illustrates the upper chassis element 28 with the front portion 28*a* comprising a first contact surface 11*a* having a first radius X, and the rear portion 28*b* comprising a second contact surface 11*b* having a second radius Y.

According to an embodiment of the inline frame, the separate chassis element, comprising at least one of the first and second contact surfaces, is adjustably arranged in relation to the upper or the lower chassis section in a longitudinal direction of the inline frame (not shown). Thus, the position of the first contact surface is adjustable with reference to the position of the upper chassis section, and/or the position of the second contact surface is adjustable with reference to the position of the lower chassis section. Preferably, the first contact surface and/or the second contact surface are/is adjustable in the inline frame longitudinal direction. This allows the user to position the radius of curvature into a preferred position below the foot. Thereby an adaptation to the user's personal style of skating is advantageously achieved.

According to an embodiment of the inline frame, the lower chassis section is adjustably arranged in relation to the upper chassis section. Preferably the lower chassis section is adjustable in a longitudinal direction of the inline frame.

According to an alternative embodiment of the inline frame, the coupling element is adjustably arranged in relation to the upper chassis section or the lower chassis section. Preferably the coupling element is adjustable in a longitudinal direction of the inline frame.

In alternative embodiments, it is conceivable that the axle 23 is integrated in the lower chassis section 6 or the upper chassis section 5. It is also conceivable that the nut 25 is integrated in the lower chassis section 6 or the upper chassis section 5.

According to an embodiment of the inline frame, the bushing 24 is integrated in the upper chassis section or the lower chassis section.

In alternative embodiments the bushing 24 may be comprised of at least one spring or at least one other component with a springy (elastic) effect suitable for the purpose.

According to an alternative embodiment of the inline frame, the coupling element is arranged without the bushing 24.

In alternative embodiments, it is conceivable that the upper chassis section 5 can be integrated in a boot 2.

Even if certain preferred embodiments have been described in detail, variations and modifications within the scope of the invention can become apparent for specialists in the field and all such are regarded as falling within the scope of the following claims. For example, the number of wheels and the distance between the wheels can vary greatly within the scope of the present invention. Thus, the inline frame 1, 10 may also include three wheels, and even five or more wheels.

In alternative embodiments, it is conceivable that the inline frame 1 includes at least two connecting elements 7. If the inline frame 1 is equipped with three wheels the first coupling element 7 may for example be positioned between the first wheel 14 and the second wheel 15. The second coupling element 7 is then placed between the second wheel 15 and the third wheel 16. If the inline frame 1 includes four wheels the first coupling element, in alternative embodiments, may be placed between the first wheel 14 and the second wheel 15. The second coupling element 7 may then be placed between the third wheel 16 and the fourth wheel 17. If the inline frame 1 includes five wheels the first coupling element, in alternative embodiments, may be placed between the first wheel 14 and the second wheel 15 or between the second wheel 15 and the third wheel 16. The second coupling element 7 may be placed between the fourth wheel 17 and a fifth wheel or between the third wheel 16 and the fourth wheel 17.

In alternative embodiments, it is conceivable that all wheels have the same diameter and are arranged in a vertical direction so that all wheels have simultaneous ground contact.

In the detailed description of the present invention, design details may have been omitted which are apparent to persons skilled in the art. Such obvious design details are included to the extent necessary so that the proper and full performance of the present invention is achieved. For example, components such as washers, screws, wheel axles, bearings, threaded rods or rivets are included to the extent necessary so that an adequate function is obtained.

With the present invention it is possible to mimic skating, with a completely or partially curved blade, on ice. With the present invention it is possible to improve training efficiency significantly compared to existing designs. With the present design it is for example possible for an ice hockey player to achieve the same element of balance as skating performed on ice, with an inline skate. The element of balance provides for muscle activation similar to what, for example, an ice hockey player experiences on ice. This brings about an important benefit because it is now possible to convey the effects of fitness and speed training with the present invention to skating on ice. Furthermore, it is possible for a hockey player to skate with an element of balance which is even tougher than the one on ice. This is of great advantage because a skater can challenge the body's sense of balance so that it is forced to refine its movement patterns. This leads to more efficient movement and also improved balance both of which are essential for a good technical execution of all the aspects of the game that an ice hockey player faces. A further benefit is how the element of balance together with the wheels mutual placement makes the inline frame easier to handle during directional changes. This will increase similarities with an ice hockey blade and its properties on ice. This feature also has benefits for the non-professional skater in that they attain a smoother transition between strides and can better handle changes in direction. Skating is thereby perceived as being more comfortable and less cumbersome. Yet another benefit is the training effect that the element of balance has on the body's stabilizing muscles which for example helps prevent and counteract back problems.

The invention claimed is:

1. An inline frame for inline skates, comprising:

an upper chassis section;

a lower chassis section; and at least a first coupling element, the first coupling element including a first portion and a second portion, the upper chassis section and the lower chassis section being engaged by way of the first coupling element such that the first coupling element holds the upper chassis section and the lower chassis section together, wherein the upper chassis section and the lower chassis section are arranged to rock relative to each other along a longitudinal direction of the inline frame such that, when the upper chassis section rocks in a forwards direction relative to a neutral position, compression of the first portion of the first coupling element increases, and when the upper chassis section rocks in a backwards direction relative to the neutral position, compression of the second portion of the first coupling element increases, the inline frame comprising a first contact surface and a second contact surface, of which at least one is curvilinear, which are arranged to bear against each other, and arranged such that during relative rocking of the upper chassis section and lower chassis section, the first contact surface and the second contact surface rock against each other, wherein said first contact surface is a surface of the upper chassis section, said second contact surface is a surface of the lower chassis section, said first contact surface is curvilinear, and said second contact surface is flat.

2. An inline skate comprising an inline frame according to claim 1.

3. An inline frame according to claim 1, wherein the first coupling element includes at least one axle.

4. An inline frame according to claim 3, further comprising at least one resilient bushing.

5. An inline frame according to claim 4, wherein the bushing consists of rubber.

6. An inline frame according to claim 4, wherein the bushing consists of at least one spring.

7. An inline frame according to claim 1, wherein the first coupling element consists of an axle arranged essentially horizontally in the inline frame's transverse direction.

8. An inline frame according to claim 1, wherein the first coupling element includes at least two bushings.

9. An inline frame according to claim 1, wherein the inline frame is integrated with a boot.

10. An inline frame according to claim 1, further comprising at least one resilient bushing.

11. An inline frame for inline skates, comprising:

an upper chassis section;

a lower chassis section; and at least a first coupling element, the first coupling element including a first portion and a second portion, the upper chassis section and the lower chassis section being engaged by way of the first coupling element such that the first coupling element holds the upper chassis section and the lower chassis section together, wherein the upper chassis section and the lower chassis section are arranged to rock relative to each other along a longitudinal direction of the inline frame such that, when the upper chassis section rocks in a forwards direction relative to a neutral position, compression of the first portion of the first coupling element increases, and when the upper chassis section rocks in a backwards direction relative to the neutral position, compression of the second portion of the first coupling element increases, the inline frame comprising a first contact surface and a second contact surface, of which at least one is curvilinear, which are arranged to bear against each other, and arranged such that during relative rocking of the upper chassis section and lower chassis section, the first contact surface and the second contact surface rock against each other, wherein said first contact surface is a surface of the upper chassis section, said second contact surface is a surface of the lower chassis section, said first contact surface is flat, and said second contact surface is curvilinear.

12. An inline frame according to claim 11, wherein the first coupling element includes at least one axle.

13. An inline frame according to claim 12, further comprising at least one resilient bushing.

14. An inline frame according to claim 13, wherein the bushing consists of rubber.

15. An inline frame according to claim 13, wherein the bushing consists of at least one spring.

16. An inline frame according to claim 11, wherein the first coupling element consists of an axle arranged essentially horizontally in the inline frame's transverse direction.

17. An inline frame according to claim 11, wherein the first coupling element includes at least two bushings.

18. An inline frame according to claim 11, wherein the inline frame is integrated with a boot.

19. An inline frame according to claim 11, further comprising at least one resilient bushing.

20. An inline frame for inline skates, comprising:

an upper chassis section;

a lower chassis section; and at least a first coupling element, the first coupling element including a first portion and a second portion, the upper chassis section and the lower chassis section being engaged by way of the first coupling element such that the first coupling element holds the upper chassis section and the lower chassis section together, wherein the upper chassis section and the lower chassis section are arranged to rock relative to each other along a longitudinal direction of the inline frame such that, when the upper chassis section rocks in a forwards direction relative to a neutral position, compression of the first portion of the first coupling element increases, and when the upper chassis section rocks in a backwards direction relative to the neutral position, compression of the second portion of the first coupling element increases, the inline frame comprising a first contact surface and a second contact surface, of which at least one is curvilinear, which are arranged to bear against each other, and arranged such that during relative rocking of the upper chassis section and lower chassis section, the first contact surface and the second contact surface rock against each other, wherein said first contact surface is curvilinear and said second contact surface is curvilinear, and wherein said first contact surface is a surface of the upper chassis section, and said second contact surface is a surface of the lower chassis section.

21. An inline frame according to claim 20, wherein the first coupling element includes at least one axle.

22. An inline frame according to claim 21, further comprising at least one resilient bushing.

23. An inline frame according to claim 22, wherein the bushing consists of rubber.

24. An inline frame according to claim 22, wherein the bushing consists of at least one spring.

25. An inline frame according to claim 20, wherein the first coupling element consists of an axle arranged essentially horizontally in the inline frame's transverse direction.

26. An inline frame according to claim 20, wherein the first coupling element includes at least two bushings.

27. An inline frame according to claim 20, wherein the inline frame is integrated with a boot.

28. An inline frame according to claim 20, further comprising at least one resilient bushing.

29. An inline frame for inline skates, comprising:

an upper chassis section;

a lower chassis section; and at least a first coupling element, the first coupling element including a first portion and a second portion, the upper chassis section and the lower chassis section being engaged by way of the first coupling element such that the first coupling element holds the upper chassis section and the lower chassis section together, wherein the upper chassis section and the lower chassis section are arranged to rock relative to each other along a longitudinal direction of the inline frame such that, when the upper chassis section rocks in a forwards direction relative to a neutral position, compression of the first portion of the first coupling element increases, and when the upper chassis section rocks in a backwards direction relative to the neutral position, compression of the second portion of the first coupling element increases, the inline frame further comprising a first contact surface and a second contact surface, of which at least one is curvilinear, which are arranged to bear against each other, and arranged such that during relative rocking of the upper chassis section and lower chassis section, the first contact surface and the second contact surface rock against each other, the inline frame further comprising a separate chassis element arranged to fit between said upper chassis section and said lower chassis section, and to at least partly bear against said upper chassis section or said lower chassis section forming an exchangeable chassis element of said upper or lower chassis section comprising a contact surface corresponding to at least one of the first contact surface and the second contact surface.

30. An inline frame according to claim 29, wherein said exchangeable chassis element comprises a separate front portion and a separate rear portion.

31. An inline frame according to claim 29, wherein said chassis element is adjustably arranged in relation to the upper or lower chassis section in a longitudinal direction of the inline frame.

32. An inline frame according to claim 29, further comprising at least one resilient bushing.

33. An inline frame for inline skates, comprising:

an upper chassis section;

a lower chassis section; and at least a first coupling element, the first coupling element including a first portion and a second portion, the upper chassis section and the lower chassis section being engaged by way of the first coupling element such that the first coupling element holds the upper chassis section and the lower chassis section together, wherein the upper chassis section and the lower chassis section are arranged to rock relative to each other along a longitudinal direction of the inline frame such that, when the upper chassis section rocks in a forwards direction relative to a neutral position, compression of the first portion of the first coupling element increases, and when the upper chassis section rocks in a backwards direction relative to the neutral position, compression of the second portion of the first coupling element increases, the inline frame comprising a first contact surface and a second contact surface, of which at least one is curvilinear, which are arranged to bear against each other, and arranged such that during relative rocking of the upper chassis section and lower chassis section, the first contact surface and the second contact surface rock against each other, wherein the first contact surface and the second contact surface extend along substantially the whole inline frame.

34. An inline frame according to claim 33, wherein the first coupling element includes at least one axle.

35. An inline frame according to claim 34, further comprising at least one resilient bushing.

36. An inline frame according to claim 35, wherein the bushing consists of rubber.

37. An inline frame according to claim 35, wherein the bushing consists of at least one spring.

38. An inline frame according to claim 33, wherein the first coupling element consists of an axle arranged essentially horizontally in the inline frame's transverse direction.

39. An inline frame according to claim 33, wherein the first coupling element includes at least two bushings.

40. An inline frame according to claim 33, wherein the inline frame is integrated with a boot.

41. An inline frame according to claim 33, further comprising at least one resilient bushing.

* * * * *